US005738117A

United States Patent [19]

Fontaine, Jr.

[11] Patent Number: 5,738,117

[45] Date of Patent: Apr. 14, 1998

[54] COMBINATION CIGAR CUTTER AND LIGHTER DEVICE

[75] Inventor: Walter G. Fontaine, Jr., Narragansett, R.I.

[73] Assignee: Colibri Corporation, Providence, R.I.

[21] Appl. No.: 774,757

[22] Filed: Dec. 30, 1996

[51] Int. Cl.[6] ..... A24F 13/24

[52] U.S. Cl. ..... 131/249; 431/253

[58] Field of Search ..... 131/249, 234, 131/292, 270, 269; 431/129, 144, 253; D27/142

[56] References Cited

U.S. PATENT DOCUMENTS

| | | | |
|---|---|---|---|
| 317,980 | 5/1885 | Dixon | 131/248 |
| 815,219 | 3/1906 | Rooll | 131/249 |
| 4,600,022 | 7/1986 | Pierce, Jr. | 131/243 |

*Primary Examiner*—Vincent Millin
*Assistant Examiner*—Charles W. Anderson
*Attorney, Agent, or Firm*—Salter & Michaelson

[57] ABSTRACT

A combination cigar cutter and lighter device for cutting off an end of a cigar and lighting same includes a casing having a body, a lighting mechanism for producing a flame, and a cavity formed in the body, and a cigar cutter having a planar ring member with a central opening and a narrow slot formed therein. A narrow blade holder is positioned within the narrow slot of the ring member, the blade holder being movable between a first position in which the blade holder is substantially removed from the slot and a second position in which the blade holder is completely received within the slot. The blade holder has a blade secured thereto for cutting off the end of the cigar upon moving the blade holder from its first position to its second position. The ring member of the cigar cutter is pivotally secured to the casing for movement between an open use position and a closed non-use position in which the ring member is disposed within the cavity.

5 Claims, 4 Drawing Sheets

COMBINATION CIGAR CUTTER AND LIGHTER DEVICE

BACKGROUND AND SUMMARY OF THE INVENTION

This invention relates generally to cigar paraphernalia, and more particularly to a combination cigar cutter and lighter device that is capable of both cutting the closed end of a cigar and lighting the cigar after it is cut.

The popularity of cigar smoking in this country has greatly risen over the past couple of years. A typical cigar includes filler tobacco at its center, a binder in the form of a leaf which holds the filler together, and an outer wrapper which is rolled around the binder. This configuration includes all but the thinnest cigars. In a handmade cigar, the filler, and wrapper are combined manually to create the cigar. Such handmade cigars have a closed end or head portion which is received in the smoker's mouth and an open end or foot portion which is lighted by the smoker.

The proper tools for cutting and lighting cigars are accessories that enhance the cigar smoking experience. More specifically, an experienced cigar smoker will leave the head portion of the cigar in its finished, pre-smoked state until the cigar is smoked. This serves to maximize flavor and freshness of the cigar. Before smoking, the smoker cuts the finished head portion with a tool to provide a neat, clean cut. There are a number of different tools presently available for cutting off the finished head portion of the cigar. For example, there are V-shaped cutters, core punchers and slicers, all of which provide a clean cut to ensure proper circulation through the body of the cigar when it is smoked.

In general, the present invention is directed to a combination cigar cutter and lighter device for cutting off an end of a cigar and lighting same. The device comprises a casing having a body, lighting means for producing a flame, and a cavity formed in the body, and a cigar cutter having a planar ring member with a central opening and a narrow slot formed therein. The narrow slot is formed within the ring member along a plane generally transverse with respect to the opening. A narrow blade holder is positioned within the narrow slot of the ring member, the blade holder being movable between a first position in which the blade holder is substantially removed from the slot and a second position in which the blade holder is completely received within the slot. The blade holder has a blade secured thereto for cutting off the end of the cigar upon moving the blade holder from its first position to its second position. Means of the present invention secures the ring member of the cigar cutter to the casing in a position in which the ring member is disposed within the cavity.

More specifically, the body of the casing is box-shaped and has four side walls and an end wall closing one end of the body, the cavity being formed in one of the side walls. The securing means comprises hinge means for hingedly attaching the ring member to the casing between a closed position in which the ring member is received within the cavity of the casing and an open position in which the ring member is pivoted away from the casing. The hinge means comprises a pair of oppositely projecting pins formed on the ring member. The pins are received within apertures formed in adjacent side walls to the side wall having the cavity for achieving the pivotal movement of the ring member with respect to the body of the casing between its closed and open positions.

Accordingly, among the several objects of the present invention are: the provision of an improved combination cigar cutter and lighter device which has a common casing for both cutting and lighting a cigar thereby eliminating the need of having separate cutter and lighter; the provision of such a device having a uniquely designed fold-out cutter which is movable between an open or operating position and a closed or stowed position in which it lies within a cavity formed in the casing; the provision of such a device which is neat and attractive in appearance; and the provision of such a device that is simple in design and easy to manufacture and assemble.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
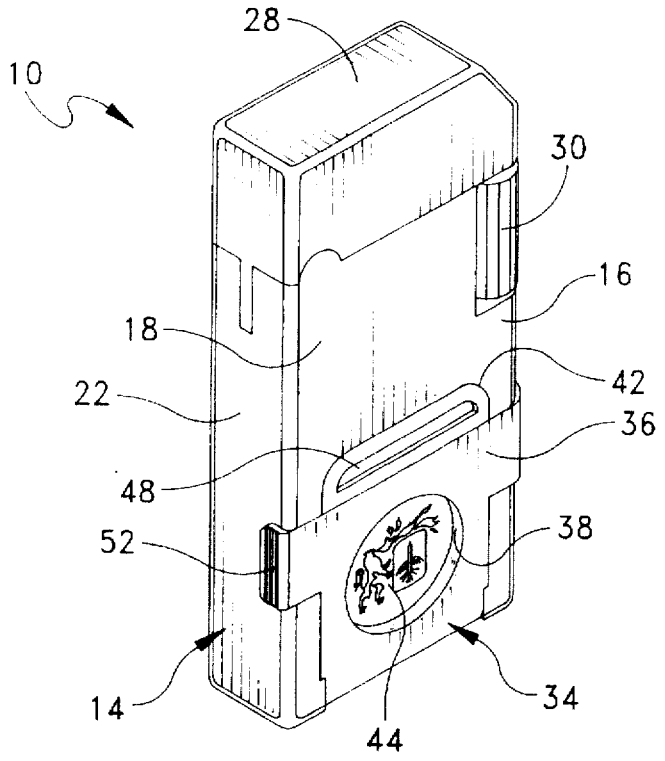
FIG. 1 is a perspective view of a combination cigar cutter and lighter device of the present invention.
Figure 2:
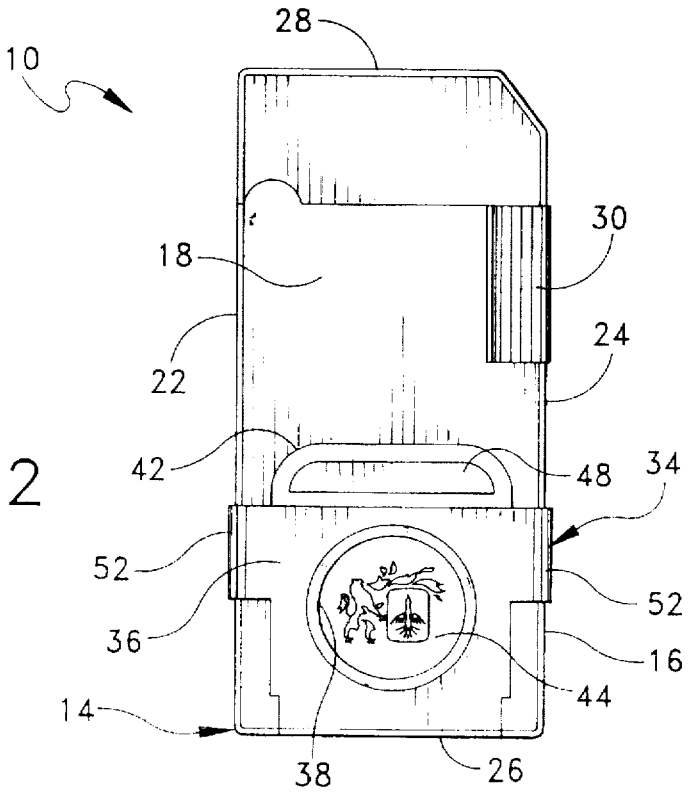
FIG. 2 is a front elevational view of the device.
Figure 7:
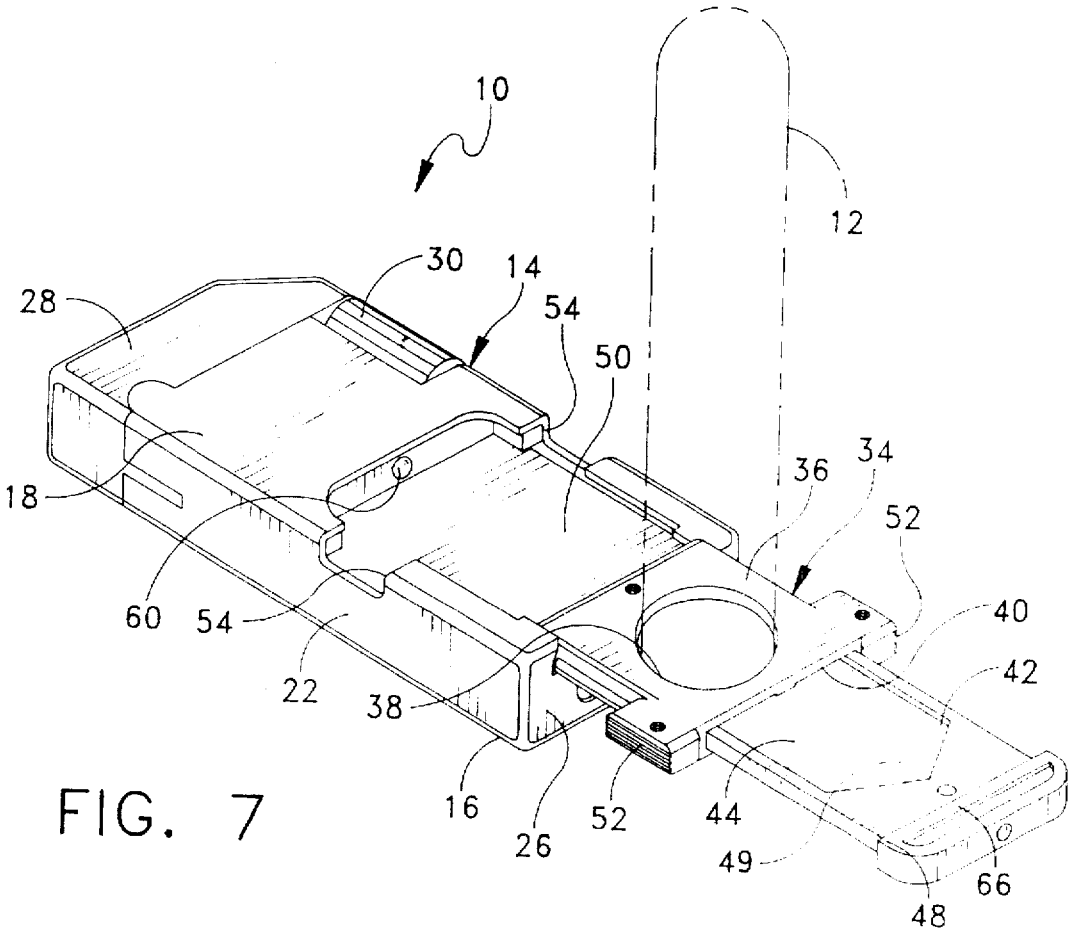
FIG. 7 is an perspective view of the device illustrating a cigar in broken lines which is received within an opening of the blade holder prior to cutting.

Referring now to the drawings, and more particularly to FIGS. 1, 2 and 7, there is generally indicated at 10 a combination cigar cutter and lighter of the present invention. The device 10 is especially suited for removing the finished head portion of a cigar 12 (FIG. 7), and for lighting the cigar 12 thereafter. The device 10 includes a casing, generally indicated at 14, which houses the necessary elements for performing these two functions. Thus, the present invention eliminates the need of having a cutter, completely separate and distinct from the lighter for cutting and lighting the cigar 12.

The casing 14 of the device 10 houses the elements necessary for producing a flame. More specifically, the casing 14 has a rectangularly-shaped body 16, the body 16 having four elongate side walls 18, 20, 22 and 24, an end wall 26 which closes one end of the body 16, and a cover 28 which selectively closes the other end of the body 16. The cover 28 is pivotally connected to one of the side walls of the body 16, e.g., side wall 22, for selective movement between the illustrated closed position and an open position (not shown) to access the components necessary for producing the flame. As shown, the casing 14 has an aperture (not designated) through which a spark generating wheel 30 protrudes. It should be understood that the device 10 of the present invention is constructed similarly to commonly available lighters that are well known in the art.

Figure 3:
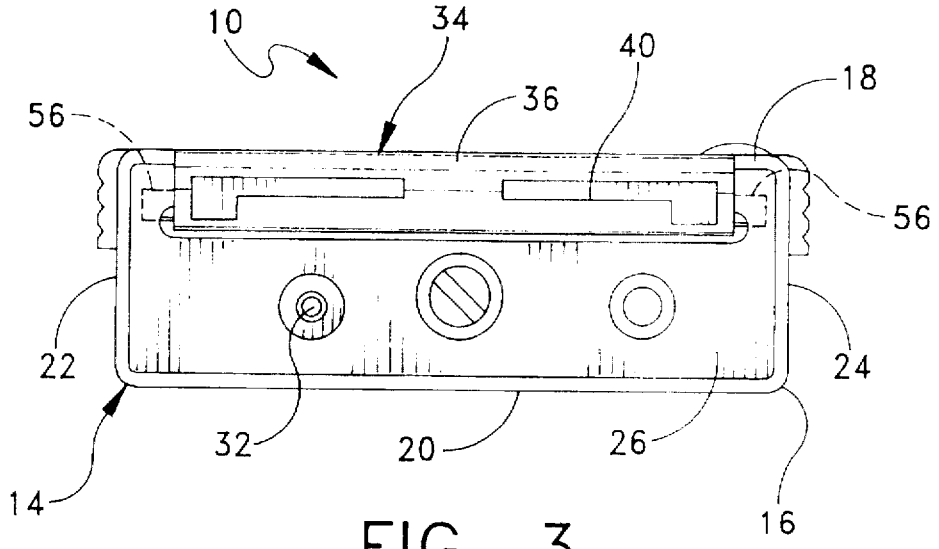
FIG. 3 is an enlarged bottom view of the device.

In this regard, the spark generating wheel 30 is manually rotated, the wheel 30 engaging a flint member (not shown)

to generate the sparks that ignite butane released through a fuel nozzle (also not shown) positioned adjacent the wheel 30. The casing 14 further houses a container (further not shown) for storing butane therein. As illustrated in FIG. 3, the container is accessed through a one-way valve 32 provided at the end wall 26 of the body 16 of the casing 14.

It should be understood that the flame producing mechanism of the present invention can embody any type of device and still fall within the scope and spirit of the present invention. The present invention is not directed to a novel flame producing mechanism, but to a device 10 which, in one common housing or casing 14, can cut off the head portion of the cigar 12 and also light the cigar.

Figure 4:
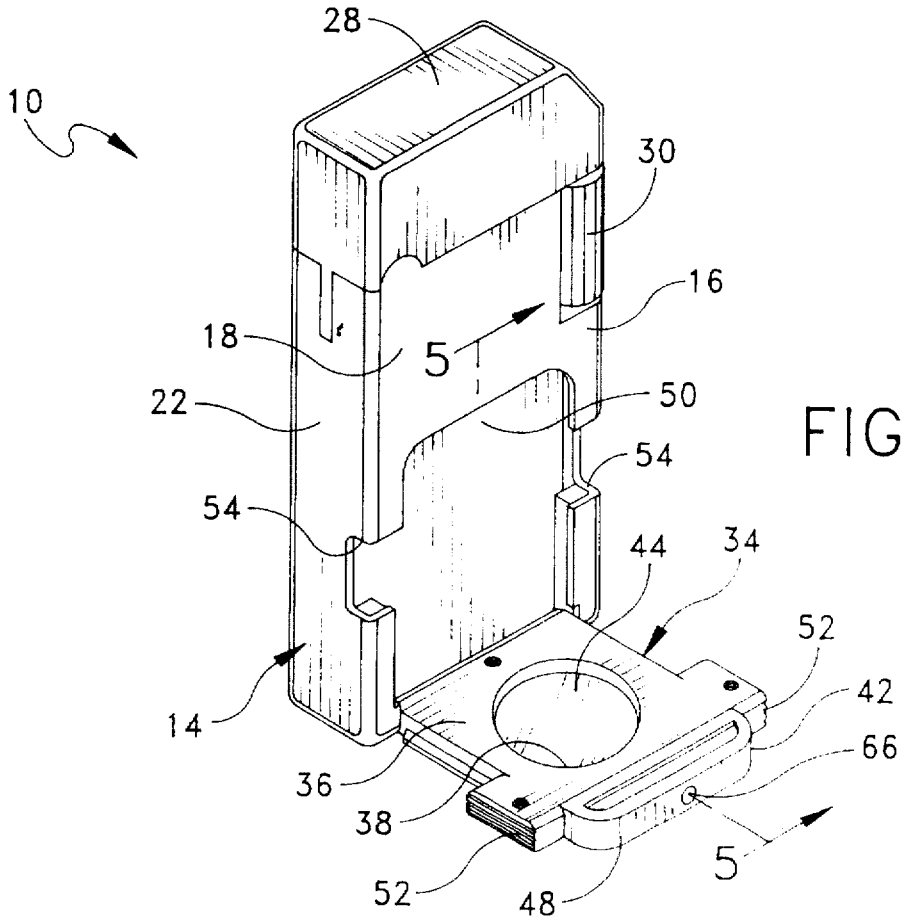
FIG. 4 is a perspective view of the device illustrating a cigar cutter of the device in an outwardly folded, open position.
Figure 5:
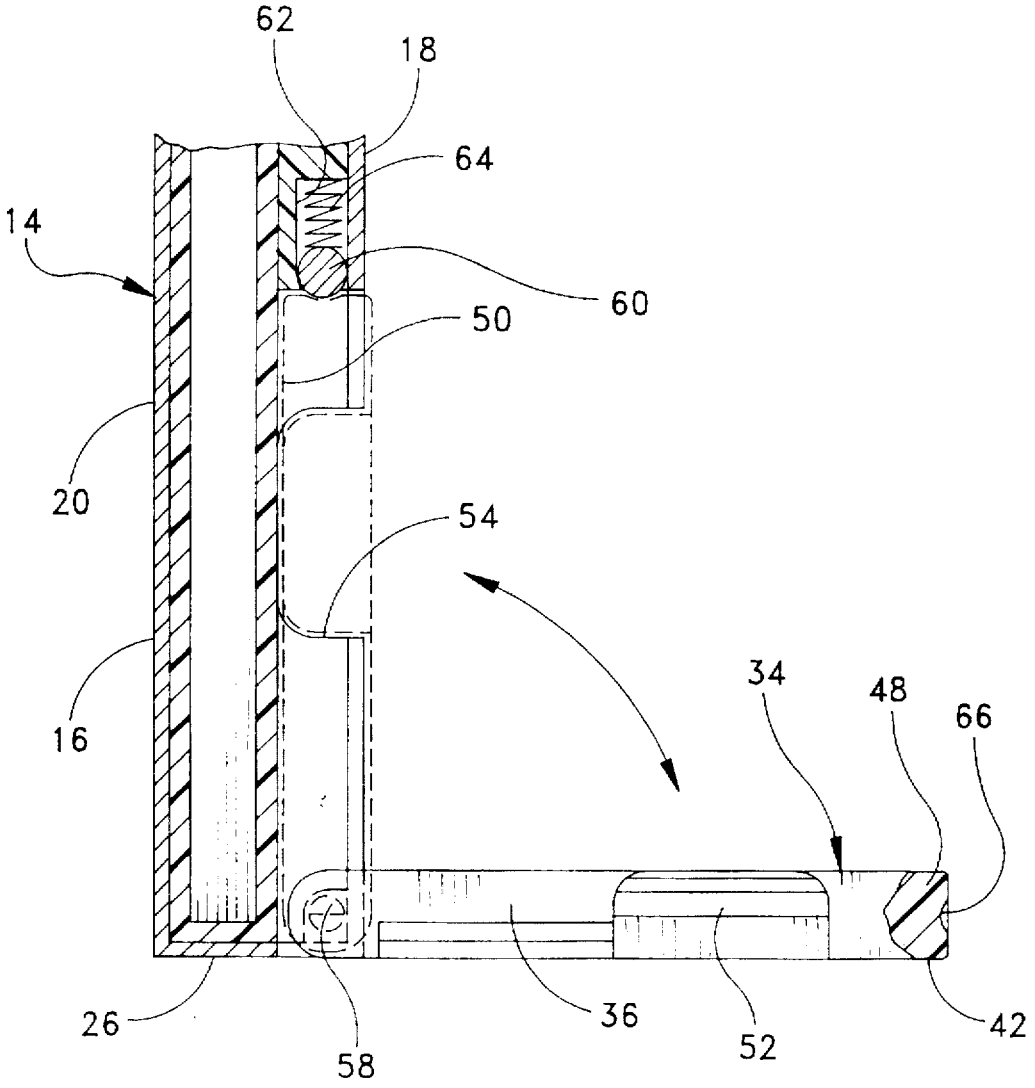
FIG. 5 is a cross-sectional view of the device taken along line 5—5 of FIG. 4.
Figure 6:
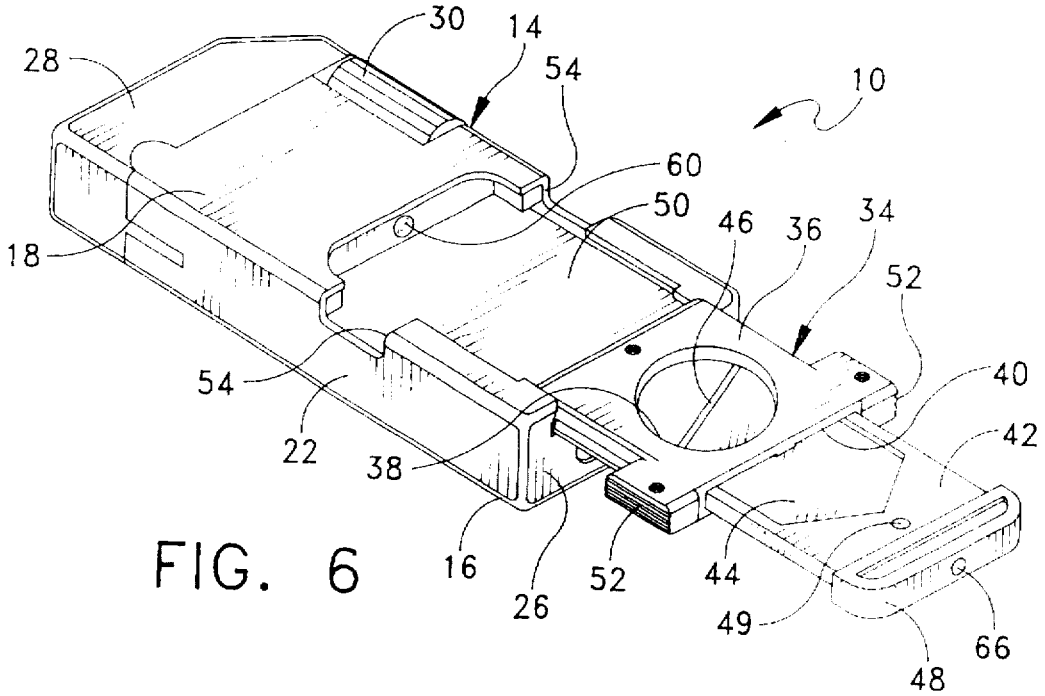
FIG. 6 is a perspective view of the device illustrating a blade holder of the cigar cutter in a pre-cutting position.

Referring now to FIGS. 4 and 5, the device 10 further comprises a cigar cutter, generally indicated at 34, for cutting the head portion of the cigar 12. As shown, the cigar cutter 34 has a rectangularly-shaped, planar ring member 36 having a relatively large central opening 38 formed therein, the purpose of which will become apparent as the description of the cutter 34 proceeds. There is also a narrow slot 40 formed in the ring member 36 (see FIG. 5), the slot 40 being formed along a plane generally transverse with respect to the opening 38.

Turning now to FIGS. 4–7, received within the narrow slot 40 of the ring member 36 is a narrow blade holder 42 that is movable between a first position in which the blade holder 42 is substantially removed from the slot 40 (FIGS. 6 and 7) and a second position in which the blade holder 42 is completely received within the slot 40 (FIGS. 4 and 5). The blade holder 42 is constructed to hold a blade 44 of standard construction, the blade 44 having a sharp edge 46 (FIG. 6) which, when cutting the head portion of the cigar 12, produces a clean cut. A handle portion 48, provided on the outer end of the blade holder 42, enables the smoker to easily move the blade holder 42 between its first and second positions. The arrangement is such that the smoker moves the blade holder 42 from its first to its second position and disposes the head portion of the cigar 12 in the large opening 38 of the ring member 36. Upon moving the blade holder 42 to its first position, the head portion of the cigar 12 is cut and ready to be smoked. A small protrusion or bump 49 retains the blade holder 42 in its first position until it is pulled outwardly to its second position by a nominal force.

Turning back to FIGS. 1–5, the ring member 36 of the cutter 34 is secured to the casing 14 in a position in which the ring member 36 is disposed within a cavity 50 formed in one of the walls (e.g., wall 18) of the casing 14. In the present invention, the ring member 36 is hingedly attached to the casing 14; however, it should be understood that other methods of securement, such as a slide mount or a bayonet-type mount, can be used as well. As shown, the ring member 36 is hingedly connected to the two relatively narrow side walls 22, 24 adjacent the end wall 26 of the casing 14 between a closed position in which the ring member 36 is received within the cavity 50 of the casing 14 (FIGS. 1 and 2) and an open position in which the ring member 36 is pivoted away from the casing 14 (FIGS. 4 and 5). The ring member 36 is further provided with a pair of oppositely projecting gripping surfaces, each indicated at 52 which extend through respective cut outs 54 formed in the adjacent side walls 22, 24 of the casing 14 for gripping the ring member 36 and moving the cutter 34 to its open position.

The ring member 36 is pivotally attached to the casing 14 by a pair of oppositely projecting pins (see FIG. 3), each indicated at 56. Each pin 56 is received within an aperture 58 (see FIG. 5) formed in the respective narrow side wall (22 or 24) for achieving the pivotal movement of the ring member 36 with respect to the body 16 of the casing 14 between its closed and open positions. In order to maintain the ring member 36 in its closed position, a detent 60 is housed within a bore 62 formed in the casing 14, the detent 60 being positioned adjacent the handle portion 48 of the blade holder 42 for engaging the blade holder 42 of the cutter 34. As shown, a spring 64, seated within the bore 62, biases the detent 60 towards the cutter 34 for ensuring that the detent 60 engages the cutter 34. The detent 60 is received within a recess 66 formed along an edge of the handle portion 48 of the blade holder 42 and is seated therein for retaining the cutter 34 to the casing 14 when the cutter 34 is in its closed position.

The operation of the device 10 is as follows. In order to move the cutter 34 from its closed, streamline position of FIGS. 1 and 2 to its open position of FIGS. 4–7, nominal force is applied to the gripping surfaces 52 of the ring member 36 for moving the cutter 34 away from the casing 14. This action pushes the detent 60 against the bias of the spring 64 so that the detent 60 is removed from the recess 66 of the blade holder 42, thereby enabling the cutter 34 to easily move to its open position. For operating the cutter 34, the blade holder 42 is then pulled outwardly to its second position. At this point, the head portion of the cigar 12 is disposed within the large opening 38 of the ring member 36 and the blade holder 42 is moved back to its first position. This action achieves the severing or cutting of the head portion of the cigar 12 so that the cigar can be smoked.

After removing the head portion of the cigar 12, the cutter 34 is hingedly moved back to its closed position so that the device 10 can be safely used to light the cigar 12 by the smoker. This is realized by opening the cover 28 and rotating the spark producing wheel 30 for producing a flame in a conventional manner. Once the cigar 12 is lighted by the smoker, the cover 28 can be returned to its closed position.

Thus, it should be observed that the device 10 disclosed herein provides an effective and efficient means for both cutting off the head portion of the cigar 12 and lighting the same without having two separate and distinct components for achieving these two functions. It can therefore be seen that for these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A combination cigar cutter and lighter device for cutting off an end of a cigar and lighting same, said device comprising:

a box-like casing having lighting means therein for producing a flame adjacent one end of the casing, said casing comprising a plurality of substantially flat walls;

one of said walls having a recessed cavity therein located adjacent the other end of the casing;

a cigar cutter having a planar ring member with a central opening and a thin slot formed therein extending generally transverse with respect to said opening, and a thin blade holder assembly positioned within said thin slot, said blade holder assembly being movable between a first position wherein the blade of said assembly is positioned so as not to cover said opening and a second position wherein the blade has slid across the opening to cut off the end of a cigar positioned in said opening;

said planar ring member fitting snugly within said recessed cavity so as to form a substantially flush continuation of said one wall surface; and hinge means securing said planar ring member to said casing at the bottom edge of said one wall whereby said planar ring member may be swung outwardly from said recessed cavity when it is desired to perform the aforesaid cutting operation.

2. In the device of claim 1, said recessed cavity extending substantially across said one wall but not completely thereacross and having notches on opposite sides thereof extending through the side edges of said one wall, said planar ring member having outwardly extending gripping members that seat within said notches, said gripping members being exposed for easy grasping by a user of the device to swing the planar ring member to its outward operative position.

3. In the device of claim 2, said gripping members extending outwardly slightly beyond the side edges of said one wall to facilitate grasping of said gripping members.

4. In the device of claim 1, said blade holder assembly comprising a planar handle portion for facilitating movement of said assembly between its first and second positions, said recessed cavity having a portion which snugly receives said handle portion.

5. In the device of claim 4, said handle portion and said recessed cavity having cooperating detent means for releasably maintaining said planar ring member within said recessed cavity.

* * * * *